US012163736B2

(12) United States Patent
Han et al.

(10) Patent No.: US 12,163,736 B2
(45) Date of Patent: Dec. 10, 2024

(54) MIXED REFRIGERANT HYDROGEN LIQUEFACTION DEVICE AND METHOD OF USING SAME

(71) Applicant: HANGZHOU OXYGEN PLANT GROUP CO., LTD., Hangzhou (CN)

(72) Inventors: Yisong Han, Hangzhou (CN); Yan Qin, Hangzhou (CN); Kuan Zhang, Hangzhou (CN); Zhongmin Ji, Hangzhou (CN); Zhiming Xu, Hangzhou (CN); Pei Hu, Hangzhou (CN)

(73) Assignee: HANGZHOU OXYGEN PLANT GROUP CO., LTD., Hangzhou (CN)

( * ) Notice: Subject to any disclaimer, the term of this patent is extended or adjusted under 35 U.S.C. 154(b) by 281 days.

(21) Appl. No.: 17/823,517

(22) Filed: Aug. 31, 2022

(65) Prior Publication Data

US 2023/0067883 A1 Mar. 2, 2023

(30) Foreign Application Priority Data

Sep. 1, 2021 (CN) ..... 202111018608.3

(51) Int. Cl.
*F25J 1/00* (2006.01)
*F25J 1/02* (2006.01)

(52) U.S. Cl.
CPC ..... *F25J 1/0218* (2013.01); *F25J 1/001* (2013.01); *F25J 1/0055* (2013.01); *F25J 1/0057* (2013.01);
(Continued)

(58) Field of Classification Search
CPC .. F25J 1/001; F25J 1/005; F25J 1/0052; F25J 1/0055; F25J 1/0057; F25J 1/0067;
(Continued)

(56) References Cited

U.S. PATENT DOCUMENTS 9,598,946 B2 * 3/2017 Shomody ..... F25J 3/0247
10,059,895 B2 * 8/2018 Lokhandwala ..... C10G 5/06
(Continued)

FOREIGN PATENT DOCUMENTS

CN 105180595 A 6/2017
CN 112539601 A 3/2021
WO 2020156754 A1 8/2020

*Primary Examiner* — Filip Zec
(74) *Attorney, Agent, or Firm* — Proi Intellectual Property US

(57) ABSTRACT

The present disclosure designs a mixed refrigerant hydrogen liquefaction device including a normal-pressure precooling cold box, a vacuum cryogenic cold box, a hydrogen refrigeration cycle compressor unit, a nitrogen cycle refrigeration unit and a mixed refrigerant cycle refrigeration unit. The precooling section uses a mixed refrigerant process and a nitrogen cycle refrigeration process as the main sources of cold energy. The refrigerant refrigeration cycle is the main source of cold energy in the temperature range of 303K to 113K. The liquid nitrogen refrigeration cycle is the main source of cold energy in the temperature range of 130K to 80K. The hydrogen refrigeration cycle provides cold energy for the temperature range of 80K to 20K. Most of the BOG generated in a storage part is recovered by an ejector. A plate-fin heat exchanger is filled with ortho-para hydrogen conversion catalysts to realize the para hydrogen content of liquefied hydrogen ≥98%.

7 Claims, 1 Drawing Sheet

(52) U.S. Cl.
CPC ..... *F25J 1/0067* (2013.01); *F25J 1/0072* (2013.01); *F25J 1/0288* (2013.01); *F25J 1/0291* (2013.01); *F25J 2270/16* (2013.01)

(58) Field of Classification Search
CPC ..... F25J 1/0072; F25J 1/0218; F25J 1/023; F25J 1/0279; F25J 1/0288; F25J 1/0291; F25J 2205/82; F25J 2220/02; F25J 2240/60; F25J 2250/02; F25J 2270/16
See application file for complete search history.

(56) References Cited

U.S. PATENT DOCUMENTS

| | | | | |
|---|---|---|---|---|
| 10,330,381 | B2 * | 6/2019 | Gritti | F25J 1/0015 |
| 10,890,375 | B2 * | 1/2021 | Chambron | F25J 1/0037 |
| 11,204,196 | B2 * | 12/2021 | Ebert | F25J 1/0271 |
| 11,815,309 | B2 * | 11/2023 | Turney | F25J 1/001 |
| 11,859,873 | B2 * | 1/2024 | Lee | F25B 41/00 |
| 2014/0366577 | A1 * | 12/2014 | Zubrin | C10L 3/10 62/619 |
| 2020/0141637 | A1 * | 5/2020 | Turney | F25J 1/005 |

* cited by examiner

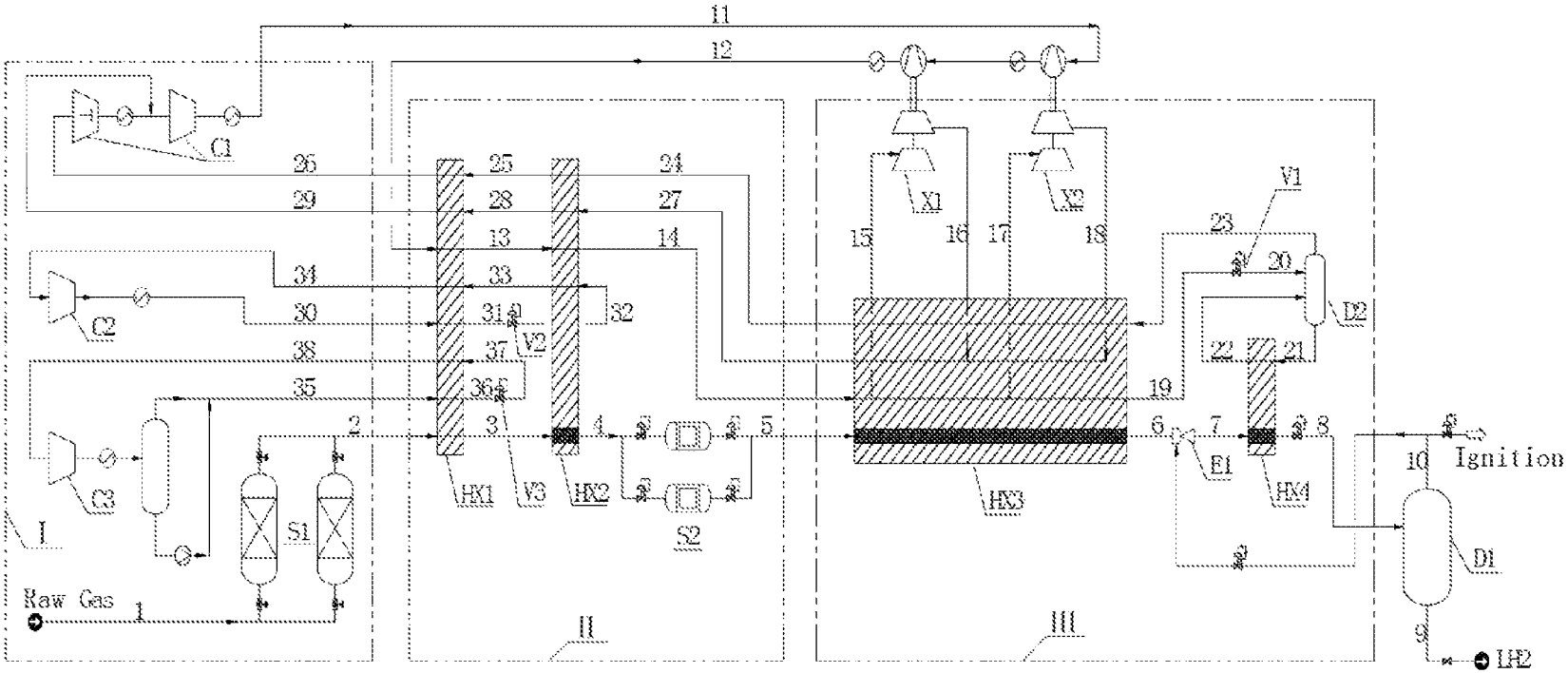
Ignition
LH2
D1
D2
V1
HX4
E1
X2
X1
HX3
III
HX2
S2
II
V3
V2
HX1
S1
C1
C2
C3
I
Raw Gas

MIXED REFRIGERANT HYDROGEN LIQUEFACTION DEVICE AND METHOD OF USING SAME

TECHNICAL FIELD

The present disclosure relates to the field of low-temperature gas liquefaction, in particular to a mixed refrigerant hydrogen liquefaction device and a method of using the same.

BACKGROUND

As an important clean energy, liquid hydrogen is mainly needed in aerospace and new energy automobile industries. The utilization of liquid hydrogen in aerospace is becoming more and more mature, and its demand growth is relatively stable. As the main means of large-scale hydrogen transportation, liquid hydrogen is becoming more and more important. The high energy consumption of liquid hydrogen production restricts the development of liquid hydrogen. The energy consumption of the existing hydrogen liquefaction device is 4.86 kw/$kg_{LH2}$ in the precooling section, 8.65 kw/$kg_{LH2}$ in the cryogenic section, and 13.5 kw/$kg_{LH2}$ in the whole. It is imperative to reduce the energy consumption of the hydrogen liquefaction process by optimizing the process.

SUMMARY

The present disclosure aims to provide a mixed refrigerant hydrogen liquefaction device, which greatly reduces the energy consumption in the hydrogen liquefaction process. According to the present disclosure, the energy consumption of the precooling section can be reduced to 3.2 kw/$kg_{LH2}$, the energy consumption of the cryogenic section can be reduced to 6.78 kw/$kg_{LH2}$, and the overall energy consumption is 10 kw/$kg_{LH2}$, which are significantly lower than those of the conventional hydrogen liquefaction device.

In order to achieve the above purpose, the present disclosure can use the following technical scheme: a mixed refrigerant hydrogen liquefaction device, wherein the device comprises a refrigerant compression unit, a precooling cold box and a cryogenic cold box which are connected with each other through pipelines, wherein the refrigerant compression unit is provided with a dehydration molecular sieve adsorber, a hydrogen compressor unit, a nitrogen compressor unit and a mixed refrigerant refrigeration unit, the precooling cold box is provided with a primary precooling heat exchanger, a secondary precooling heat exchanger and a low-temperature molecular sieve adsorber, and the cryogenic cold box is provided with a cryogenic heat exchanger, an ejector, a supercooling heat exchanger, a gas-liquid separator, a primary hydrogen expander, and a secondary hydrogen expander.

Preferably, the dehydration molecular sieve adsorber in the refrigerant compression unit is connected with a raw material hydrogen channel of the primary precooling heat exchanger and the secondary precooling heat exchanger and the low-temperature molecular sieve adsorber in the precooling cold box through a second pipeline, a third pipeline and a fourth pipeline, and then is connected with a raw hydrogen channel of the cryogenic heat exchanger, the ejector, and a raw hydrogen channel of the supercooling heat exchanger in the cryogenic cold box in sequence through a fifth pipeline, a sixth pipeline and a seventh pipeline to form a circulation channel in the whole process from raw hydrogen to liquid hydrogen.

Preferably, the outlet of the hydrogen compressor unit in the refrigerant compression unit is connected with the supercharging ends of the primary hydrogen expander and the secondary hydrogen expander and high-pressure circulating hydrogen channels of the primary precooling heat exchanger and the secondary precooling heat exchanger in the precooling cold box in sequence through an eleventh pipeline, a twelfth pipeline and a thirteenth pipeline, and then is connected with a high-pressure circulating hydrogen channel of the cryogenic heat exchanger in the cryogenic cold box through a fourteenth pipeline, and is connected with the primary hydrogen expander, the secondary hydrogen expander and a throttle valve through a fifteenth pipeline, a seventeenth pipeline and a nineteenth pipeline among three branch pipelines, respectively, the throttle valve is connected with low-temperature circulating hydrogen channels of the gas-liquid separator and the supercooling heat exchanger in sequence through a twentieth pipeline, a twenty-first pipeline and a twenty-second pipeline, the gas-liquid separator is connected with a first low-pressure circulating hydrogen channel of the cryogenic heat exchanger, first low-pressure circulating hydrogen channels of the secondary precooling heat exchanger and the primary precooling heat exchanger, and a low-pressure section of the hydrogen compressor unit in sequence through a twenty-third pipeline, a twenty-fourth pipeline, a twenty-fifth pipeline and a twenty-sixth pipeline, the primary hydrogen expander and the secondary hydrogen expander are connected with a second low-pressure circulating hydrogen channel of the cryogenic heat exchanger through a sixteenth pipeline and an eighteenth pipeline, respectively, and then connected with second low-pressure circulating hydrogen channels of the secondary precooling heat exchanger and the primary precooling heat exchanger, and a high-pressure section of the hydrogen compressor unit through a twenty-seventh pipeline, a twenty-eighth pipeline, and a twenty-ninth pipeline, so as to form a hydrogen refrigeration circulation channel.

Preferably, the outlet of the nitrogen compressor unit is connected with a high-pressure nitrogen channel of the primary precooling heat exchanger and a throttle valve in the precooling cold box in sequence through a thirtieth pipeline and a thirty-first pipeline, and then is connected with the inlets of the secondary precooling heat exchanger, the primary precooling heat exchanger and the nitrogen compressor unit through a thirty-second pipeline, a thirty-third pipeline and a thirty-fourth pipeline in sequence to form a nitrogen refrigeration circulation channel, and the outlet of the mixed refrigerant compressor unit is connected with a high-pressure refrigerant channel of the primary precooling heat exchanger and a throttle valve in the precooling cold box through a thirty-fifth pipeline and a thirty-sixth pipeline in sequence, and then is connected with the inlets of the primary precooling heat exchanger and the mixed refrigerant compressor unit through a thirty-seventh pipeline and a thirty-eighth pipeline in sequence to form a mixed refrigerant refrigeration circulation channel.

Preferably, the primary precooling heat exchanger, the secondary precooling heat exchanger, the cryogenic heat exchanger and the supercooling heat exchanger are all high-efficiency plate-fin heat exchangers, the primary hydrogen expander and the secondary hydrogen expander are both centrifugal expanders braked by a supercharger, the low-pressure section of the hydrogen compressor unit is a reciprocating compressor, the high-pressure section of the hydrogen compressor unit is a centrifugal compressor, and the nitrogen compressor unit and the mixed refrigerant compressor unit are centrifugal compressors.

A method of using the mixed refrigerant hydrogen liquefaction device comprises the following steps:

1) raw hydrogen is communicated with an inlet pipeline of the dehydration molecular sieve adsorber, removes water to 0.1 ppm, then enters the primary precooling heat exchanger in the precooling cold box through the second pipeline to be cooled to 113K, and then enters the secondary precooling heat exchanger filled with ortho-para hydrogen conversion catalysts through the third pipeline for ortho-para hydrogen conversion to be cooled to 80K; and then enters the low-temperature molecular sieve adsorber through the fourth pipeline to remove trace oxygen, nitrogen, argon and methane, the material flow from the low-temperature adsorber is communicated with the fifth pipeline of the cryogenic cold box, and enters the cryogenic heat exchanger filled with ortho hydrogen and para hydrogen conversion catalysts to be cooled to 25K, the material flow from HX3 is communicated with the ejector through the sixth pipeline to reduce the pressure to 0.57 Mpa, at the same time, BOG gas is introduced and enters the supercooling heat exchanger filled with ortho hydrogen and para hydrogen conversion catalysts through the seventh pipeline so as to be cooled to 22K, and then the throttle valve transfers liquid hydrogen to a storage system, and the BOG in the storage system is reliquefied through the ejector;

2) the outlet of the hydrogen compressor unit is communicated with the supercharging ends of the primary hydrogen expander and the secondary hydrogen expander through the eleventh pipeline in sequence, and the high-pressure hydrogen is supercharged in sequence, then passes through the twelfth pipeline and the thirteenth pipeline in sequence, and is cooled to 80 k in the precooling cold box; the high-pressure hydrogen is communicated with the cryogenic heat exchanger in the cryogenic cold box through the fourteenth pipeline, after the high-pressure hydrogen is cooled to 70K, a separated stream enters the primary hydrogen expander through the fifteenth pipeline to be cooled to 44.3K, and then returns to the cryogenic heat exchanger through the sixteenth pipeline, after another stream is further cooled to 50K, another separated stream enters the secondary hydrogen expander through the seventeenth pipeline to be cooled to 28.8K, returns to the cryogenic heat exchanger through the eighteenth pipeline, and then is merged with the stream at the outlet of the primary hydrogen expander after being reheated and passes through the cryogenic heat exchanger, and then is communicated with the precooling heat exchanger and the precooling heat exchanger through a twenty-seventh pipeline and a twenty-eighth pipeline in sequence, the hydrogen medium returns to the inlet of the high-pressure section of the hydrogen compressor unit through a twenty-ninth pipeline after being reheated; the remaining stream is further cooled to 25K, and is connected to the throttle valve through the nineteenth pipeline, and is communicated with the gas-liquid separator through the twentieth pipeline after the throttle valve is cooled to 20K; after gas-liquid separation, the liquid phase is communicated with the supercooling heat exchanger through the twenty-first pipeline, the liquid hydrogen returns to the gas-liquid separator through the twenty-second pipeline after being partially evaporated in the supercooling heat exchanger to form a thermosyphon loop; the gas phase of the gas-liquid separator is communicated with the cryogenic heat exchanger, the secondary precooling heat exchanger and the primary precooling heat exchanger through the twenty-third pipeline, the twenty-fourth pipeline and the twenty-fifth pipeline in sequence, and then enters the low-pressure section of the hydrogen compressor unit through the twenty-sixth pipeline after being reheated to normal temperature, and then is merged with the medium-pressure hydrogen into the high-pressure section of the hydrogen compressor unit after being supercharged through the low-pressure section of the hydrogen compressor unit, so as to form a set of hydrogen refrigeration cycle;

3) the nitrogen at the outlet of the nitrogen compressor unit enters the precooling cold box through a thirtieth pipeline, is cooled to 113K through the primary precooling heat exchanger, is communicated with the throttle valve through the thirty-first pipeline, and is communicated with the secondary precooling heat exchanger and the primary precooling heat exchanger through a thirty-second pipeline and a thirty-third pipeline in sequence after the throttle valve is cooled to 80K, and then returns to the inlet of the nitrogen compressor unit through a thirty-fourth pipeline, so as to form a set of nitrogen refrigeration cycle and provide cold energy for the temperature range of 113K to 80K.

4) the mixed refrigerant at the outlet of the mixed refrigerant compressor unit enters the precooling cold box and the primary precooling heat exchanger through a thirty-fifth pipeline to be cooled to 113K, and is communicated with the throttle valve through the thirty-sixth pipeline, returns to the primary precooling heat exchanger through a thirty-seventh pipeline after the throttle valve is cooled, leaves the precooling cold box through a thirty-eighth pipeline and returns to the inlet of the mixed refrigerant compressor unit, so as to form a set of mixed refrigerant refrigeration cycle and provide cooling energy for the temperature range of 303 K to 113 K.

Preferably, the proportions of ortho hydrogen and para hydrogen in step 1) are 2.2% and 97.8%, respectively, and the proportions of ortho hydrogen and para hydrogen in the storage system are 1% and 99%, respectively.

Preferably, the medium of the nitrogen refrigeration cycle in step 3) is pure nitrogen.

Preferably the mixed refrigerant in step 4) consists of methane, ethylene, propane, isopentane and nitrogen.

The present disclosure has the positive effects that the above scheme reduces the loss of the purification, conversion and liquefaction processes as much as possible through the continuous conversion and heat exchange of the ortho-para hydrogen conversion catalysts in the secondary precooling heat exchanger, the cryogenic heat exchanger and the supercooling heat exchanger, the impurity removal by low-temperature adsorption, and the recovery of BOG by the ejector, thus reducing the energy consumption. The energy consumption of the cryogenic section is reduced to 6.78 kw/$kg_{LH2}$ through two sets of two-stage expander refrigeration and liquid hydrogen throttling refrigeration. The energy consumption of the precooling section is reduced to 3.2 kw/$kg_{LH2}$ by using nitrogen cycle refrigeration and mixed refrigerant cycle refrigeration. The overall energy consumption of the hydrogen liquefaction process is 10 kw/$kg_{LH2}$, which is significantly lower than that of the conventional hydrogen liquefaction method.

The dehydration molecular sieve adsorber (S1) in the refrigerant compression unit (I) is connected with a raw material hydrogen channel of the primary precooling heat exchanger (HX1) and the secondary precooling heat exchanger (HX2) and the low-temperature molecular sieve adsorber (S2) in the precooling cold box (II) through a second pipeline (2), a third pipeline (3) and a fourth pipeline (4), and then is connected with a raw hydrogen channel of the cryogenic heat exchanger (HX3), the ejector (E1), and a raw hydrogen channel of the supercooling heat exchanger (HX4) in the cryogenic cold box (III) in sequence through a fifth pipeline (5), a sixth pipeline (6) and a seventh pipeline (7) to form a circulation channel in the whole process from raw hydrogen to liquid hydrogen.

The outlet of the hydrogen compressor unit (C1) in the refrigerant compression unit (I) is connected with the supercharging ends of the primary hydrogen expander (X1) and the secondary hydrogen expander (X2) and high-pressure circulating hydrogen channels of the primary precooling heat exchanger (HX1) and the secondary precooling heat exchanger (HX2) in the precooling cold box (II) in sequence through an eleventh pipeline (11), a twelfth pipeline (12) and a thirteenth pipeline (13), and then is connected with a high-pressure circulating hydrogen channel of the cryogenic heat exchanger (HX3) in the cryogenic cold box (III) through a fourteenth pipeline (14), and is connected with the primary hydrogen expander (X1), the secondary hydrogen expander (X2) and a throttle valve (V1) through a fifteenth pipeline (15), a seventeenth pipeline (17) and a nineteenth pipeline (19) among three branch pipelines, respectively, the throttle valve (V1) is connected with low-temperature circulating hydrogen channels of the gas-liquid separator (D2) and the supercooling heat exchanger (HX4) in sequence through a twentieth pipeline (20), a twenty-first pipeline (21) and a twenty-second pipeline (22), the gas-liquid separator (D2) is connected with a first low-pressure circulating hydrogen channel of the cryogenic heat exchanger (HX3), first low-pressure circulating hydrogen channels of the secondary precooling heat exchanger (HX2) and the primary precooling heat exchanger (HX1), and a low-pressure section of the hydrogen compressor unit (C1) in sequence through a twenty-third pipeline (23), a twenty-fourth pipeline (24), a twenty-fifth pipeline (25) and a twenty-sixth pipeline (26), the primary hydrogen expander (X1) and the secondary hydrogen expander (X2) are connected with a second low-pressure circulating hydrogen channel of the cryogenic heat exchanger (HX3) through a sixteenth pipeline (16) and an eighteenth pipeline (18), respectively, and then connected with second low-pressure circulating hydrogen channels of the secondary precooling heat exchanger (HX2) and the primary precooling heat exchanger (HX1), and a high-pressure section of the hydrogen compressor unit (C1) through a twenty-seventh pipeline (27), a twenty-eighth pipeline (28), and a twenty-ninth pipeline (29), so as to form a hydrogen refrigeration circulation channel.

BRIEF DESCRIPTION OF THE DRAWINGS

FIG. 1 is a schematic structural diagram of the present disclosure.

DETAILED DESCRIPTION OF THE EMBODIMENTS

The present disclosure will be described in detail with reference to the attached drawings hereinafter. As shown in FIG. 1, the hydrogen liquefaction device according to the present disclosure comprises a refrigerant compression unit I, a precooling cold box II and a cryogenic cold box III which are connected with each other through pipelines, wherein the refrigerant compression unit I is provided with a dehydration molecular sieve adsorber S1, a hydrogen compressor unit C1, a nitrogen compressor unit C2 and a mixed refrigerant refrigeration unit C3. The precooling cold box II is provided with a primary precooling heat exchanger HX1, a secondary precooling heat exchanger HX2 and a low-temperature molecular sieve adsorber S2. The cryogenic cold box III is provided with a cryogenic heat exchanger HX3, an ejector E1, a supercooling heat exchanger HX4, a gas-liquid separator D2, a primary hydrogen expander X1, and a secondary hydrogen expander X2. The dehydration molecular sieve adsorber S1 in the refrigerant compression unit I is connected with a raw material hydrogen channel of the primary precooling heat exchanger HX1 and the secondary precooling heat exchanger HX2 and the low-temperature molecular sieve adsorber S2 in the precooling cold box II through a second pipeline 2, a third pipeline 3 and a fourth pipeline 4, and then is connected with a raw hydrogen channel of the cryogenic heat exchanger HX3, the ejector E1, and a raw hydrogen channel of the supercooling heat exchanger HX4 in the cryogenic cold box III in sequence through a fifth pipeline 5, a sixth pipeline 6 and a seventh pipeline 7 to form a circulation channel in the whole process from raw hydrogen to liquid hydrogen. The outlet of the hydrogen compressor unit C1 in the refrigerant compression unit I is connected with the supercharging ends of the primary hydrogen expander X1 and the secondary hydrogen expander X2 and high-pressure circulating hydrogen channels of the primary precooling heat exchanger HX1 and the secondary precooling heat exchanger HX2 in the precooling cold box II in sequence through an eleventh pipeline 11, a twelfth pipeline 12 and a thirteenth pipeline 13, and then is connected with a high-pressure circulating hydrogen channel of the cryogenic heat exchanger HX3 in the cryogenic cold box III through a fourteenth pipeline 14, and is connected with the primary hydrogen expander X1, the secondary hydrogen expander X2 and a throttle valve V1 through a fifteenth pipeline 15, a seventeenth pipeline 17 and a nineteenth pipeline 19 among three branch pipelines, respectively. The throttle valve V1 is connected with low-temperature circulating hydrogen channels of the gas-liquid separator D2 and the supercooling heat exchanger HX4 in sequence through a twentieth pipeline 20, a twenty-first pipeline 21 and a twenty-second pipeline 22. The gas-liquid separator D2 is connected with a first low-pressure circulating hydrogen channel of the cryogenic heat exchanger HX3, first low-pressure circulating hydrogen channels of the secondary precooling heat exchanger HX2 and the primary precooling heat exchanger HX1, and a low-pressure section of the hydrogen compressor unit C1 in sequence through a twenty-third pipeline 23, a twenty-fourth pipeline 24, a twenty-fifth pipeline 25 and a twenty-sixth pipeline 26. The primary hydrogen expander X1 and the secondary hydrogen expander X2 are connected with a second low-pressure circulating hydrogen channel of the cryogenic heat exchanger HX3 through a sixteenth pipeline 16 and an eighteenth pipeline 18, respectively, and then connected with second low-pressure circulating hydrogen channels of the secondary precooling heat exchanger HX2 and the primary precooling heat exchanger HX1, and a high-pressure section of the hydrogen compressor unit C1 through a twenty-seventh pipeline 27, a twenty-eighth pipeline 28, and a twenty-ninth pipeline 29, so as to form a hydrogen refrigeration circulation channel. The outlet of the nitrogen compressor unit C2 is connected with a high-pressure nitrogen channel of the primary precooling heat exchanger HX1 and a throttle valve V2 in the precooling cold box II in sequence through a thirtieth pipeline 30 and a thirty-first pipeline 31, and then is connected with the inlets of the secondary precooling heat exchanger HX2, the primary precooling heat exchanger HX1 and the nitrogen compressor unit C2 through a thirty-second pipeline 32, a thirty-third pipeline 33 and a thirty-fourth pipeline 34 in sequence to form a nitrogen refrigeration circulation channel. The outlet of the mixed refrigerant compressor unit C3 is connected with a high-pressure refrigerant channel of the primary precooling heat exchanger HX1 and a throttle valve V3 in the precooling cold box II through a thirty-fifth pipeline 35 and a thirty-sixth pipeline 36 in sequence, and then is connected with the inlets of the primary precooling heat exchanger HX1 and the mixed refrigerant compressor unit C3 through a thirty-seventh pipeline 37 and a thirty-eighth pipeline 38 in sequence to form a mixed refrigerant refrigeration circulation channel. The primary precooling heat exchanger HX1, the secondary precooling heat exchanger HX2, the cryogenic heat exchanger HX3 and the supercooling heat exchanger HX4 are all high-efficiency plate-fin heat exchangers. The primary hydrogen expander X1 and the secondary hydrogen expander X2 are both centrifugal expanders braked by a supercharger. The low-pressure section of the hydrogen compressor unit C1 is a reciprocating compressor. The high-pressure section of the hydrogen compressor unit C1 is a centrifugal compressor. The nitrogen compressor unit C2 and the mixed refrigerant compressor unit C3 are centrifugal compressors.

A method of using the mixed refrigerant hydrogen liquefaction device comprises the following steps:

1) raw hydrogen is communicated with an inlet pipeline 1 of the dehydration molecular sieve adsorber S1, removes water to 0.1 ppm, then enters the primary precooling heat exchanger HX1 in the precooling cold box II through the second pipeline 2 to be cooled to 113K, and then enters the secondary precooling heat exchanger HX2 filled with ortho-para hydrogen conversion catalysts through the third pipeline 3 for ortho-para hydrogen conversion to be cooled to 80K; and then enters the low-temperature molecular sieve adsorber S2 through the fourth pipeline 4 to remove trace oxygen, nitrogen, argon and methane, the material flow from the low-temperature adsorber is communicated with the fifth pipeline 5 of the cryogenic cold box III, and enters the cryogenic heat exchanger HX3 filled with ortho hydrogen and para hydrogen conversion catalysts to be cooled to 25K, the proportions of ortho hydrogen and para hydrogen are 2.2% and 97.8%, respectively, the material flow from HX3 is communicated with the ejector E1 through the sixth pipeline 6 to reduce the pressure to 0.57 Mpa, at the same time, BOG gas is introduced and enters the supercooling heat exchanger HX4 filled with ortho hydrogen and para hydrogen conversion catalysts through the seventh pipeline 7 so as to be cooled to 22K, and then the throttle valve transfers liquid hydrogen to a storage system, the BOG in the storage system is re-liquefied through the ejector E1, and the proportions of ortho hydrogen and para hydrogen in the storage system are 1% and 99%, respectively;

2) the outlet of the hydrogen compressor unit C1 is communicated with the supercharging ends of the primary hydrogen expander X1 and the secondary hydrogen expander X2 through the eleventh pipeline 11 in sequence, and the high-pressure hydrogen is supercharged in sequence, then passes through the twelfth pipeline 12 and the thirteenth pipeline 13 in sequence, and is cooled to 80 k in the precooling cold box II; the high-pressure hydrogen is communicated with the cryogenic heat exchanger HX3 in the cryogenic cold box III through the fourteenth pipeline 14, after the high-pressure hydrogen is cooled to 70K, a separated stream enters the primary hydrogen expander X1 through the fifteenth pipeline 15 to be cooled to 44.3K, and then returns to the cryogenic heat exchanger HX3 through the sixteenth pipeline 16, after another stream is further cooled to 50K, another separated stream enters the secondary hydrogen expander X2 through the seventeenth pipeline 17 to be cooled to 28.8K, returns to the cryogenic heat exchanger HX3 through the eighteenth pipeline 18, and then is merged with the stream at the outlet of the primary hydrogen expander X1 after being reheated and passes through the cryogenic heat exchanger HX3, and then is communicated with the precooling heat exchanger HX2 and the precooling heat exchanger HX1 through a twenty-seventh pipeline 27 and a twenty-eighth pipeline 28 in sequence, the hydrogen medium returns to the inlet of the high-pressure section of the hydrogen compressor unit C1 through a twenty-ninth pipeline 29 after being reheated; the remaining stream is further cooled to 25K, and is connected to the throttle valve V1 through the nineteenth pipeline 19, and is communicated with the gas-liquid separator D2 through the twentieth pipeline 20 after the throttle valve is cooled to 20K; after gas-liquid separation, the liquid phase is communicated with the supercooling heat exchanger HX4 through the twenty-first pipeline 21, the liquid hydrogen returns to the gas-liquid separator D2 through the twenty-second pipeline 22 after being partially evaporated in the supercooling heat exchanger HX4 to form a thermosyphon loop; the gas phase of the gas-liquid separator D2 is communicated with the cryogenic heat exchanger HX3, the secondary precooling heat exchanger HX2 and the primary precooling heat exchanger HX1 through the twenty-third pipeline 23, the twenty-fourth pipeline 24 and the twenty-fifth pipeline 25 in sequence, and then enters the low-pressure section of the hydrogen compressor unit C1 through the twenty-sixth pipeline 26 after being reheated to normal temperature, and then is merged with the medium-pressure hydrogen into the high-pressure section of the hydrogen compressor unit C1 after being supercharged through the low-pressure section of the hydrogen compressor unit C1, so as to form a set of hydrogen refrigeration cycle;

3) the nitrogen at the outlet of the nitrogen compressor unit C2 enters the precooling cold box II through a thirtieth pipeline 30, is cooled to 113K through the primary precooling heat exchanger HX1, is communicated with the throttle valve V2 through the thirty-first pipeline 31, and is communicated with the secondary precooling heat exchanger HX2 and the primary precooling heat exchanger HX1 through a thirty-second pipeline 32 and a thirty-third pipeline 33 in sequence after the throttle valve is cooled to 80K, and then returns to the inlet of the nitrogen compressor unit C2 through a thirty-fourth pipeline 34, so as to form a set of nitrogen refrigeration cycle and provide cold energy for the temperature range of 113K to 80K, and the medium of the nitrogen refrigeration cycle is pure nitrogen;

4) the mixed refrigerant at the outlet of the mixed refrigerant compressor unit C3 enters the precooling cold box II and the primary precooling heat exchanger HX1 through a thirty-fifth pipeline 35 to be cooled to 113K, and is communicated with the throttle valve V3 through the thirty-sixth pipeline 36, returns to the primary precooling heat exchanger HX1 through a thirty-seventh pipeline 37 after the throttle valve is cooled, leaves the precooling cold box II through a thirty-eighth pipeline 38 and returns to the inlet of the mixed refrigerant compressor unit C3, so as to form a set of mixed refrigerant refrigeration cycle and provide cooling energy for the temperature range of 303 K to 113 K, and the mixed refrigerant consists of methane, ethylene, propane, isopentane and nitrogen.

The above embodiments are the specific implementation of the present disclosure. Many equivalent combinations or changes can be made to the hydrogen refrigeration cycle, the nitrogen refrigeration cycle and the mixed refrigerant refrigeration cycle of the refrigerant hydrogen liquefaction device, all of which belong to the scope of protection of the present disclosure.

What is claimed is:

1. A mixed refrigerant hydrogen liquefaction device, wherein the device comprises a refrigerant compression unit (I), a precooling cold box (II) and a cryogenic cold box (III) which are connected with each other through pipelines, wherein the refrigerant compression unit (I) is provided with a dehydration molecular sieve adsorber (S1), a hydrogen compressor unit (C1), a nitrogen compressor unit (C2) and a mixed refrigerant refrigeration unit (C3), the precooling cold box (II) is provided with a primary precooling heat exchanger (HX1), a secondary precooling heat exchanger (HX2) and a low-temperature molecular sieve adsorber (S2), and the cryogenic cold box (III) is provided with a cryogenic heat exchanger (HX3), an ejector (E1), a supercooling heat exchanger (HX4), a gas-liquid separator (D2), a primary hydrogen expander (X1), and a secondary hydrogen expander (X2); wherein the dehydration molecular sieve adsorber (S1) in the refrigerant compression unit (I) is connected with a raw material hydrogen channel of the primary precooling heat exchanger (HX1) and the secondary precooling heat exchanger (HX2) and the low-temperature molecular sieve adsorber (S2) in the precooling cold box (II) through a second pipeline (2), a third pipeline (3) and a fourth pipeline (4), and then is connected with a raw hydrogen channel of the cryogenic heat exchanger (HX3), the ejector (E1), and a raw hydrogen channel of the supercooling heat exchanger (HX4) in the cryogenic cold box (III) in sequence through a fifth pipeline (5), a sixth pipeline (6) and a seventh pipeline (7) to form a circulation channel in the whole process from | raw hydrogen to liquid hydrogen; and wherein the outlet of the hydrogen compressor unit (C1) in the refrigerant compression unit (1) is connected with the supercharging ends of the primary hydrogen expander (X1) and the secondary hydrogen expander (X2) and high-pressure circulating hydrogen channels of the primary precooling heat exchanger (HX1) and the secondary precooling heat exchanger (HX2) in the precooling cold box (II) in sequence through an eleventh pipeline (11), a twelfth pipeline (12) and a thirteenth pipeline (13), and then is connected with a high-pressure circulating hydrogen channel of the cryogenic heat exchanger (HX9) in the cryogenic cold box (III) through a fourteenth pipeline (14), and is connected with the primary hydrogen expander (X1), the secondary hydrogen expander (X2) and a throttle valve (V1) through a fifteenth pipeline (15), a seventeenth pipeline (17) and a nineteenth pipeline (19) among three branch pipelines, respectively, the throttle valve (V1) is connected with low-temperature circulating hydrogen channels of the gas-liquid separator (D2) and the supercooling heat exchanger (HX4) in sequence through a twentieth pipeline (20), a twenty-first pipeline (21) and a twenty-second pipeline (22), the gas-liquid separator (D2) is connected with a first low-pressure circulating hydrogen channel of the cryogenic heat exchanger (HX3), first low-pressure circulating hydrogen channels of the secondary precooling heat exchanger (HX2) and the primary precooling heat exchanger (HX1), and a low-pressure section of the hydrogen compressor unit (C1) in sequence through a twenty-third pipeline (23), a twenty-fourth pipeline (24), a twenty-fifth pipeline (25) and a twenty-sixth pipeline (26), the primary hydrogen expander (X1) and the secondary hydrogen expander (X2) are connected with a second low-pressure circulating hydrogen channel of the cryogenic heat exchanger (HX3) through a sixteenth pipeline (16) and an eighteenth pipeline (18), respectively, and then connected with second low-pressure circulating hydrogen channels of the secondary precooling heat exchanger (HX2) and the primary precooling heat exchanger (HX1), and a high-pressure section of the hydrogen compressor unit (C1) through a twenty-seventh pipeline (27), a twenty-eighth pipeline (28), and a twenty-ninth pipeline (29), so as to form a hydrogen refrigeration circulation channel.

2. The mixed refrigerant hydrogen liquefaction device according to claim 1, wherein the outlet of the nitrogen compressor unit (C2) is connected with a high-pressure nitrogen channel of the primary precooling heat exchanger (HX1) and a throttle valve (V2) in the precooling cold box (II) in sequence through a thirtieth pipeline (30) and a thirty-first pipeline (31), and then is connected with the inlets of the secondary precooling heat exchanger (HX2), the primary precooling heat exchanger (HX1) and the nitrogen compressor unit (C2) through a thirty-second pipeline (32), a thirty-third pipeline (33) and a thirty-fourth pipeline (34) in sequence to form a nitrogen refrigeration circulation channel, and the outlet of the mixed refrigerant compressor unit (C3) is connected with a high-pressure refrigerant channel of the primary precooling heat exchanger (HX1) and a throttle valve (V3) in the precooling cold box (II) through a thirty-fifth pipeline (35) and a thirty-sixth pipeline (36) in sequence, and then is connected with the inlets of the primary precooling heat exchanger (HX1) and the mixed refrigerant compressor unit (C3) through a thirty-seventh pipeline (37) and a thirty-eighth pipeline (38) in sequence to form a mixed refrigerant refrigeration circulation channel.

3. The mixed refrigerant hydrogen liquefaction device according to claim 1, wherein the primary precooling heat exchanger (HX1), the secondary precooling heat exchanger (HX2), the cryogenic heat exchanger (HX3) and the supercooling heat exchanger (HX4) are all high-efficiency plate-fin heat exchangers, the primary hydrogen expander (X1) and the secondary hydrogen expander (X2) are both centrifugal expanders braked by a supercharger, the low-pressure section of the hydrogen compressor unit (C1) is a reciprocating compressor, the high-pressure section of the hydrogen compressor unit (C1) is a centrifugal compressor, and the nitrogen compressor unit (C2) and the mixed refrigerant compressor unit (C3) are centrifugal compressors.

4. A method of using the mixed refrigerant hydrogen liquefaction device according to claim 1, comprising the following steps:

1) Raw hydrogen is communicated with an inlet pipeline (1) of the dehydration molecular sieve adsorber (S1), removes water to 0.1 ppm, then enters the primary precooling heat exchanger (HX1) in the precooling cold box (II) through the second pipeline (2) to be cooled to 113K, and then enters the secondary precooling heat exchanger (HX2) filled with ortho-para hydrogen conversion catalysts through the third pipeline (3) for ortho-para hydrogen conversion to be cooled to 80K; and then enters the low-temperature molecular sieve adsorber (S2) through the fourth pipeline (4) to remove trace oxygen, nitrogen, argon and methane, the material flow from the low-temperature adsorber is communicated with the fifth pipeline (5) of the cryogenic cold box (III), and enters the cryogenic heat exchanger (HX3) filled with ortho hydrogen and para hydrogen conversion catalysts to be cooled to 25K, the material flow from HX3 is communicated with the ejector (E1) through the sixth pipeline (6) to reduce the pressure to 0.57 Mpa, at the same time, BOG gas is introduced and enters the supercooling heat exchanger (HX4) filled with ortho hydrogen and para hydrogen conversion catalysts through the seventh pipeline (7) so as to be cooled to 22K, and then the throttle valve transfers liquid hydrogen to a storage system, and the BOG in the storage system is re-liquefied through the ejector (E1);

2) the outlet of the hydrogen compressor unit (C1) is communicated with the supercharging ends of the primary hydrogen expander (X1) and the secondary hydrogen expander (X2) through the eleventh pipeline (11) in sequence, and the high-pressure hydrogen is supercharged in sequence, then passes through the twelfth pipeline (12) and the thirteenth pipeline (13) in sequence, and is cooled to 80 k in the precooling cold box (II); the high-pressure hydrogen is communicated with the cryogenic heat exchanger (HX3) in the cryogenic cold box (III) through the fourteenth pipeline (14), after the high-pressure hydrogen is cooled to 70K, a separated stream enters the primary hydrogen expander (X1) through the fifteenth pipeline (15) to be cooled to 44.3K, and then returns to the cryogenic heat exchanger (HX3) through the sixteenth pipeline (16), after another stream is further cooled to 50K, another separated stream enters the secondary hydrogen expander (X2) through the seventeenth pipeline (17) to be cooled to 28.8K, returns to the cryogenic heat exchanger (HX3) through the eighteenth pipeline (18), and then is merged with the stream at the outlet of the primary hydrogen expander (X1) after being reheated and passes through the cryogenic heat exchanger (HX3), and then is communicated with the precooling heat exchanger (HX2) and the precooling heat exchanger (HX1) through a twenty-seventh pipeline (27) and a twenty-eighth pipeline (28) in sequence, the hydrogen medium returns to the inlet of the high-pressure section of the hydrogen compressor unit (C1) through a twenty-ninth pipeline (29) after being reheated; the remaining stream is further cooled to 25K, and is connected to the throttle valve (V1) through the nineteenth pipeline (19), and is communicated with the gas-liquid separator (D2) through the twentieth pipeline (20) after the throttle valve is cooled to 20K; after gas-liquid separation, the liquid phase is communicated with the supercooling heat exchanger (HX4) through the twenty-first pipeline (21), the liquid hydrogen returns to the gas-liquid separator (D2) through the twenty-second pipeline (22) after being partially evaporated in the supercooling heat exchanger (HX4) to form a thermosyphon loop; the gas phase of the gas-liquid separator (D2) is communicated with the cryogenic heat exchanger (HX3), the secondary precooling heat exchanger (HX2) and the primary precooling heat exchanger (HX1) through the twenty-third pipeline (23), the twenty-fourth pipeline (24) and the twenty-fifth pipeline (25) in sequence, and then enters the low-pressure section of the hydrogen compressor unit (C1) through the twenty-sixth pipeline (26) after being reheated to normal temperature, and then is merged with the medium-pressure hydrogen into the high-pressure section of the hydrogen compressor unit (C1) after being supercharged through the low-pressure section of the hydrogen compressor unit (C1), so as to form a set of hydrogen refrigeration cycle;

3) the nitrogen at the outlet of the nitrogen compressor unit (C2) enters the precooling cold box (II) through a thirtieth pipeline (30), is cooled to 113K through the primary precooling heat exchanger (HX1), is communicated with the throttle valve (V2) through the thirty-first pipeline (31), and is communicated with the secondary precooling heat exchanger (HX2) and the primary precooling heat exchanger (HX1) through a thirty-second pipeline (32) and a thirty-third pipeline (33) in sequence after the throttle valve is cooled to 80K, and then returns to the inlet of the nitrogen compressor unit (C2) through a thirty-fourth pipeline (34), so as to form a set of nitrogen refrigeration cycle and provide cold energy for the temperature range of 113K to 80K, 4) The mixed refrigerant at the outlet of the mixed refrigerant compressor unit (C3) enters the precooling cold box (II) and the primary precooling heat exchanger (HX1) through a thirty-fifth pipeline (35) to be cooled to 113K, and is communicated with the throttle valve (V3) through the thirty-sixth pipeline (36), returns to the primary precooling heat exchanger (HX1) through a thirty-seventh pipeline (37) after the throttle valve is cooled, leaves the precooling cold box (II) through a thirty-eighth pipeline (38) and returns to the inlet of the mixed refrigerant compressor unit (C3), so as to form a set of mixed refrigerant refrigeration cycle and provide cooling energy for the temperature range of 303 K to 113 K.

5. The method of using the mixed refrigerant hydrogen liquefaction device according to claim 4, wherein the proportions of ortho hydrogen and para hydrogen in step 1) are 2.2% and 97.8%, respectively, and the proportions of ortho hydrogen and para hydrogen in the storage system are 1% and 99%, respectively.

6. The method of using the mixed refrigerant hydrogen liquefaction device according to claim 4, wherein the medium of the nitrogen refrigeration cycle in step 3) is pure nitrogen.

7. The method of using the mixed refrigerant hydrogen liquefaction device according to claim 4, wherein the mixed refrigerant in step 4) consists of methane, ethylene, propane, isopentane and nitrogen.

* * * * *